United States Patent [19]

Hartmann

[11] 4,351,859

[45] Sep. 28, 1982

[54] PROCESS FOR ENAMELING THE INSIDE SURFACE OF HOLLOW VESSELS

[75] Inventor: Ferdinand Hartmann, Vienna, Austria

[73] Assignee: Austria Email Aktiengesellschaft, Vienna, Austria

[21] Appl. No.: 136,250

[22] Filed: Apr. 1, 1980

[30] Foreign Application Priority Data

| | | | |
|---|---|---|---|
| Apr. 2, 1979 | [AT] | Austria | 2422/79 |
| Apr. 12, 1979 | [AT] | Austria | 2754/79 |
| Jun. 18, 1979 | [AT] | Austria | 4280/79 |

[51] Int. Cl.[3] ..... B05D 7/22

[52] U.S. Cl. ..... 427/232; 427/235; 427/238

[58] Field of Search ..... 427/235, 238, 232

[56] References Cited

U.S. PATENT DOCUMENTS

| | | |
|---|---|---|
| 3,078,066 | 2/1963 | Moore . |
| 3,083,943 | 4/1963 | Stewart . |

FOREIGN PATENT DOCUMENTS

| | | | |
|---|---|---|---|
| 250127 | 10/1966 | Austria . | |
| 257323 | 10/1967 | Austria . | |
| 288819 | 3/1971 | Austria . | |
| 1046351 | 12/1958 | Fed. Rep. of Germany . | |
| 1901975 | 9/1970 | Fed. Rep. of Germany . | |
| 1621398 | 4/1971 | Fed. Rep. of Germany . | |
| 1621396 | 5/1971 | Fed. Rep. of Germany . | |
| 2145439 | 3/1972 | Fed. Rep. of Germany . | |
| 2349076 | 4/1974 | Fed. Rep. of Germany . | |
| 2411881 | 9/1975 | Fed. Rep. of Germany . | |
| 2418159 | 11/1975 | Fed. Rep. of Germany . | |
| 2745216 | 4/1978 | Fed. Rep. of Germany . | |
| 2800866 | 7/1978 | Fed. Rep. of Germany . | |
| 84443 | 9/1971 | German Democratic Rep. . | |
| 96307 | 3/1973 | German Democratic Rep. . | |
| 104816 | 3/1974 | German Democratic Rep. . | |
| 49-39492 | 10/1974 | Japan | 427/235 |
| 1078903 | 8/1967 | United Kingdom | 427/238 |

*Primary Examiner*—James R. Hoffman

*Attorney, Agent, or Firm*—Fleit & Jacobson

[57] ABSTRACT

A process of enameling the inside surface of hollow vessels, which have two openings at opposite points. In a hot-water reservoir to be enameled these openings are provided at both ends. One opening is connected to a vacuum pump and the other to a conduit which incorporates a valve and leads to an enamel slip reservoir. In a first step, a vacuum pump is operated to pre-evacuate the interior of the hollow vessel so that air is removed from the pores at the inside surface of the hollow vessel. In this step the valve in the slip conduit remains closed. When the vessel has been preevacuated to about 40 to 80 torrs absolute, the valve is opened so that slip flows suddenly into the hollow vessel and fills the pores while the evacuation is continued and slip is sucked into the hollow vessel until the slip emerges from the opening through which the hollow vessel is being evacuated.

5 Claims, 5 Drawing Figures

41
42

7
50B
50A
47
56
55

PROCESS FOR ENAMELING THE INSIDE SURFACE OF HOLLOW VESSELS

SUMMARY OF INVENTION

A process of enameling the inside surface of hollow vessels having two openings. In a first step, air is sucked through one opening out of the interior of the vessel to pre-evacuate the same so that air is removed from the pores at the inside surface of the hollow vessel. At this time the path for a supply of enamel slip to the other opening of the vessel remains closed. That path is subsequently opened so that slip flows suddenly into the vessel and can easily fill the pores from which air has been removed. The evacuation is continued so that slip is sucked into the hollow vessel until it is completely filled.

This invention relates to a process of enameling the inside surface of hollow vessels, in which the hollow vessel is evacuated and enamel slip is drawn up into the hollow vessel under the action of the vacuum and is then left in the hollow vessel and is finally caused to drain from the hollow vessel at the lowermost point thereof.

The invention relates also to an apparatus which serves to carry out such process and comprises a conduit, which is adapted to be connected to the lowermost point of the hollow vessel to be enameled and which leads to a slip reservoir and incorporates a valve comprising a suitably annular sealing surface and a preferably circular diaphragm, which is gripped along its periphery on a plate or the like, and a second conduit, which is adapted to be connected to the upper end of the hollow vessel and leads to a vacuum pump and incorporates a valve.

A process of the kind described has been disclosed in Austrian Patent Specification No. 250,127 and has been found in practice to result in enamel coatings which are highly superior to those formed by the previous dipping processes.

It is an object of the invention to propose measures by which the bond between the enamel and the inside surface of the hollow vessel can be improved and defects caused by air pockets, which may form adjacent to intricate internal fixtures, can be substantially avoided.

In a process of the kind described first hereinbefore, that object is accomplished according to the invention in that the hollow vessel is pre-evacuated before the enamel slip is drawn up into the vessel. The term "pre-evacuated", as used in the application, is intended to describe the establishment of a negative pressure within the vessel prior to the introduction of slip into the vessel.

By this pre-evacuation of the hollow vessel, air will be removed even from highly fissured surface pores, narrow cracks etc. so that the enamel slip which is subsequently drawn up will be sucked even into concealed corners with a perfection which cannot be achieved in the known process.

The pre-evacuation of the hollow vessel results also in a degasification of the enamel slip to a much higher degree. As a result of the ball-milling of the enamel slip, the latter contains minute air bubbles. Tests have shown that said bubble structure is favorably influenced by the process according to the invention. The bubbles which are present are smaller and more uniformly distributed so that the adherence and the quality of the enamel are improved.

To permit a processing of the hollow vessels in rapid succession and with simple means, a further feature of the invention resides in that the hollow vessels are suspended at equally spaced apart points from a revolving endless chain or the like so that the openings at the opposite ends of each vessel are vertically spaced apart and the hollow vessels are moved in this orientation to the slip-charging and emptying station and any subsequent processing stations in steps which are equal in length to the spacing of the hollow vessels.

To ensure the formation of an enamel layer which is as uniform in thickness as possible, the hollow vessel which has been emptied is rotated in a following step in an inclined position so that a uniform distribution of the slip and a draining of surplus slip are ensured.

Apparatus of the kind described hereinbefore is proposed for carrying out the process according to the invention. In said apparatus, the space between the diaphragm and plate of the valve incorporated in the conduit leading to the slip reservoir is adapted to be supplied, in accordance with the invention, with a pressure fluid to force the sealing surface against the valve seat.

Further advantages afforded by the invention result from the features recited in the dependent claims.

Details of the invention will be explained with reference to the drawing, which shows an illustrative embodiment of the apparatus according to the invention.

Figure 1:
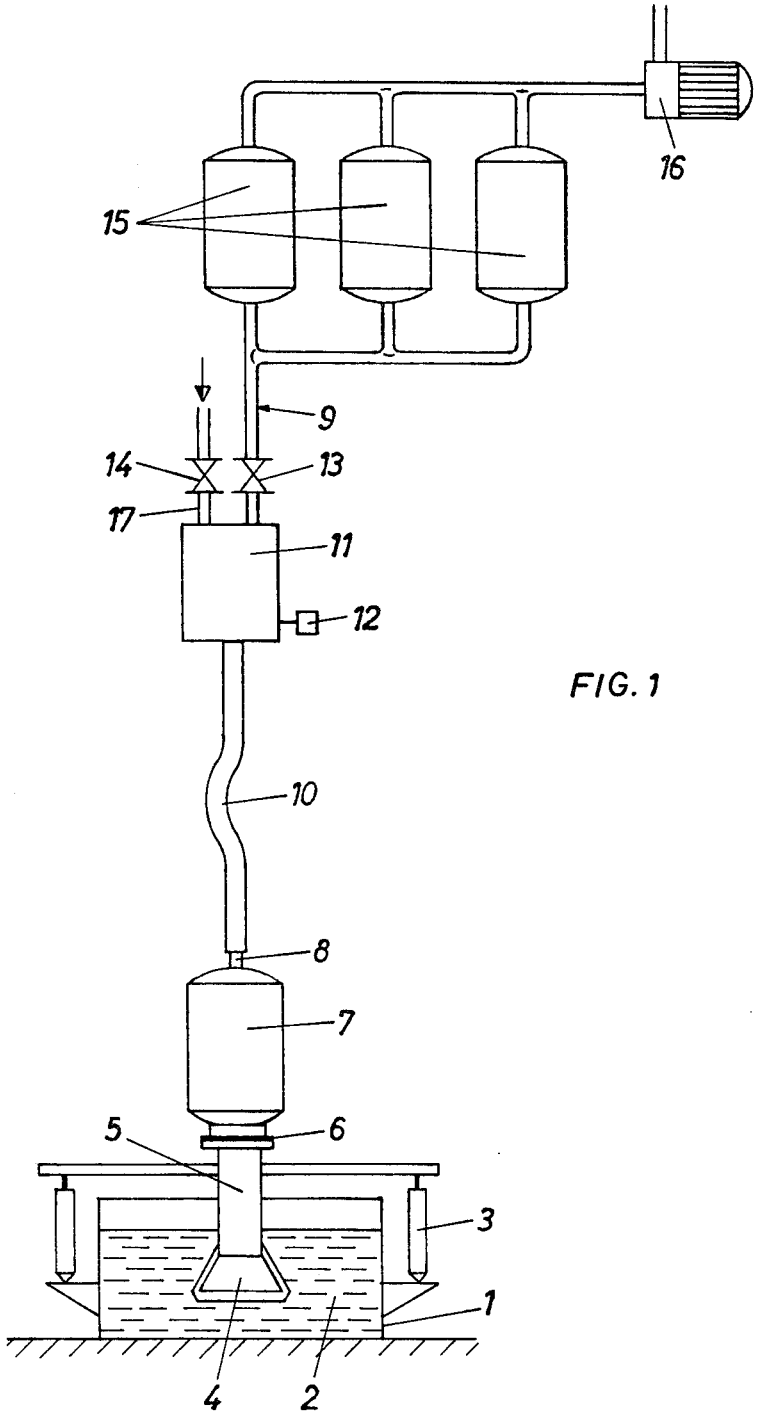
FIG. 1 is a diagrammatic view showing the station for filling the hollow vessel with slip.

The apparatus shown in FIG. 1 comprises a reservoir 1, which may be provided, if desired, with a stirrer, not shown, and in which enamel slip is mixed and brought to a suitable consistency. The hollow vessel 7 to be enameled is connected to the reservoir 1 by a connecting pipe 5 and a valve 4. A hose conduit 10 is connected by a suction pipe 8 to the top of the vessel 7 and incorporates a receiver 11 and a valve 13 and leads to a bifurcated conduit 9, which is connected by a vacuum battery 15 to a vacuum pump 16.

Valve 4 is a diaphragm valve and will be described hereinafter.

The connecting pipe 5 is provided with a seal 6 and is adjusted in height by hydraulic or pneumatic actuators 3.

The receiver 11 contains a switch 12 for actuating the valve 13 and communicates with the atmosphere through a conduit 17, which incorporates a valve 14.

The valve 4 consists of a circular baseplate 21, which has a reinforced edge portion 22 and a central recess 23. A diaphragm 25 of rubber or a similar material is gripped between the upper surface of the rim of the baseplate 21 and a retaining ring 24 and in position of rest lies flat on the upper surface of the baseplate 21.

A valve plate 26 is disposed near the central portion of the diaphragm 25 and is fixed to the diaphragm 25 with screws 27, which extend through the diaphragm 25 and are screwed into a plate 28 on the opposite side of the diaphragm 25. The valve plate 26 carries a seal ring 29.

A valve seat 33 is formed by that rim of the connecting pipe 5 which faces the valve plate 26, in the drawing by the lower rim. The connecting pipe 5 is held by a plurality of inclined radial struts 35.

In the embodiment shown by way of example, a connecting tube 36 for actuating the valve is connected to the central recess 23 of the baseplate 21. In the simplest case, the connecting tube 36 can be selectively connected to a compressed-air source and to the outside air by a three-way valve (not shown). To permit an enforced opening of the valve, a vacuum source may be provided in addition to the compressed-air source and may be adapted to be connected by the three-way valve to the space between the diaphragm 25 and the baseplate 21 in alternation with the compressed-air source.

Figure 2:
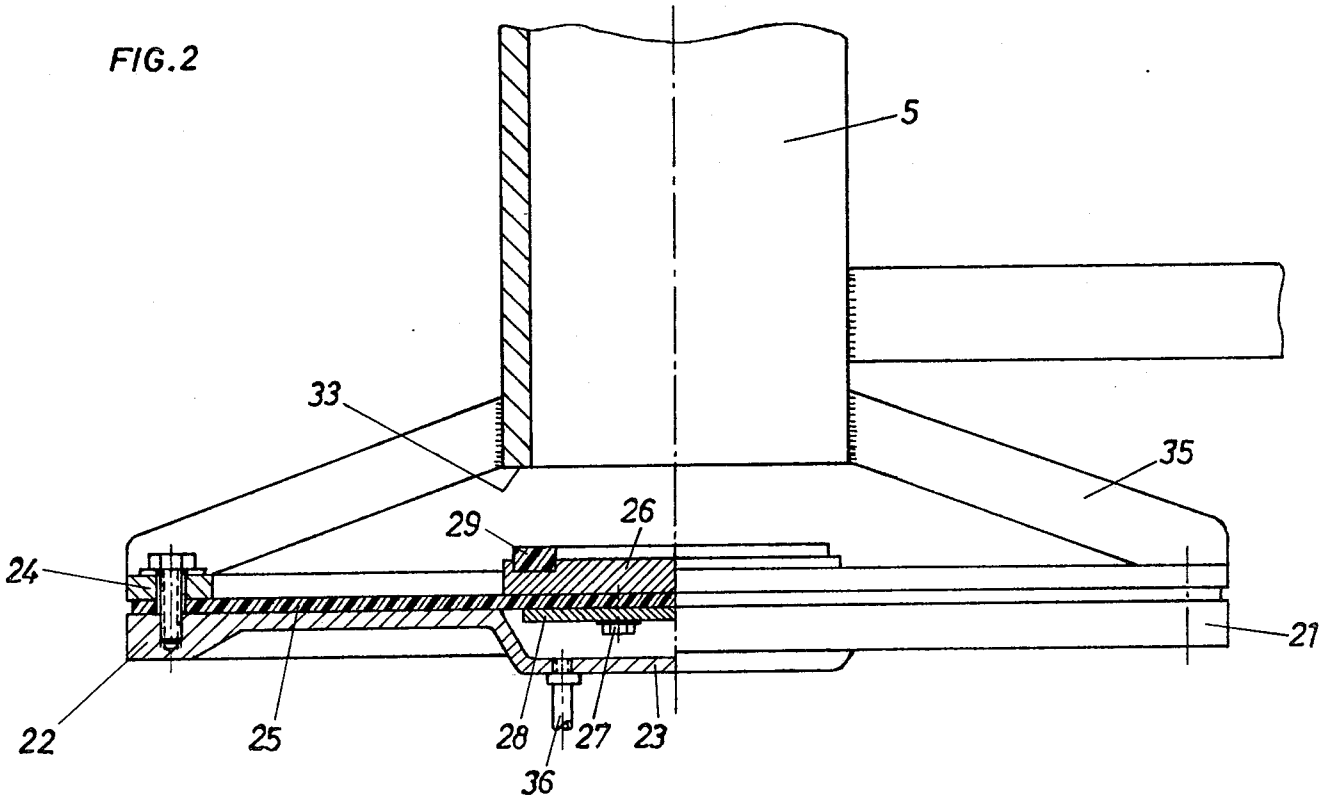
FIG. 2 is an enlarged view showing in elevation, partly in section, the valve incorporated in the conduit which leads to the slip reservoir.
Figure 3:
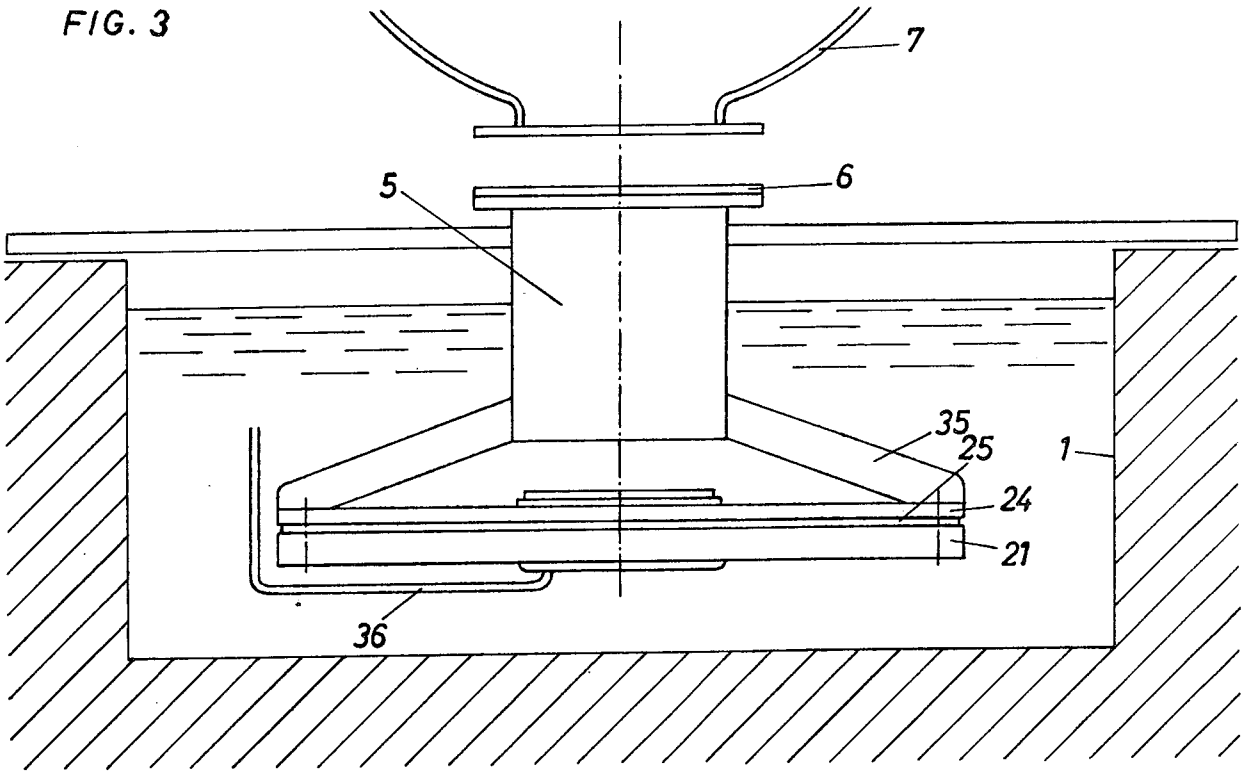
FIG. 3 shows the valve of FIG. 2 provided in the slip reservoir or slip pot of FIG. 1.
Figure 4:
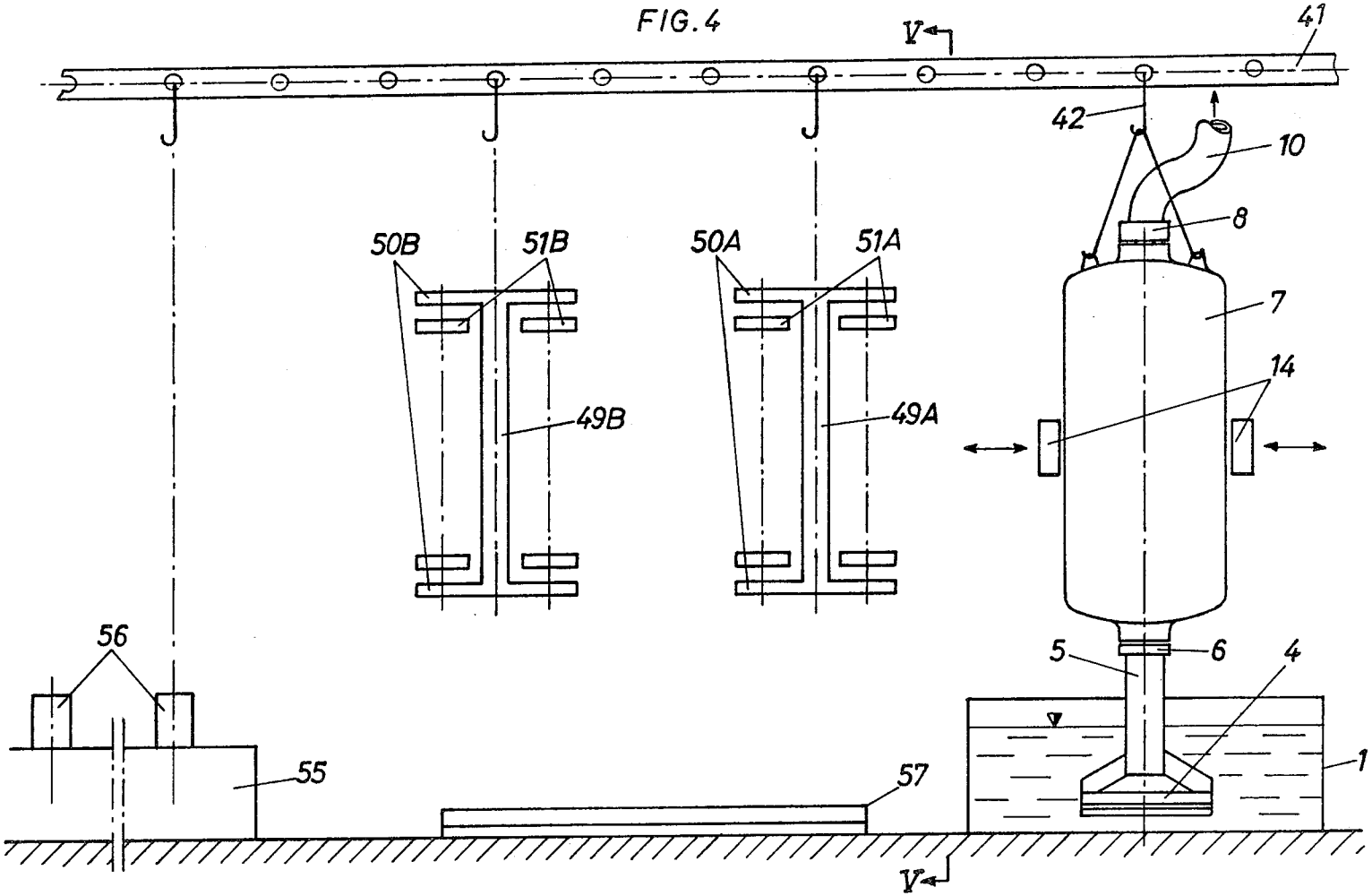
FIG. 4 is an elevation showing the means for moving the hollow vessel through several stations of the processing plant.
Figure 5:
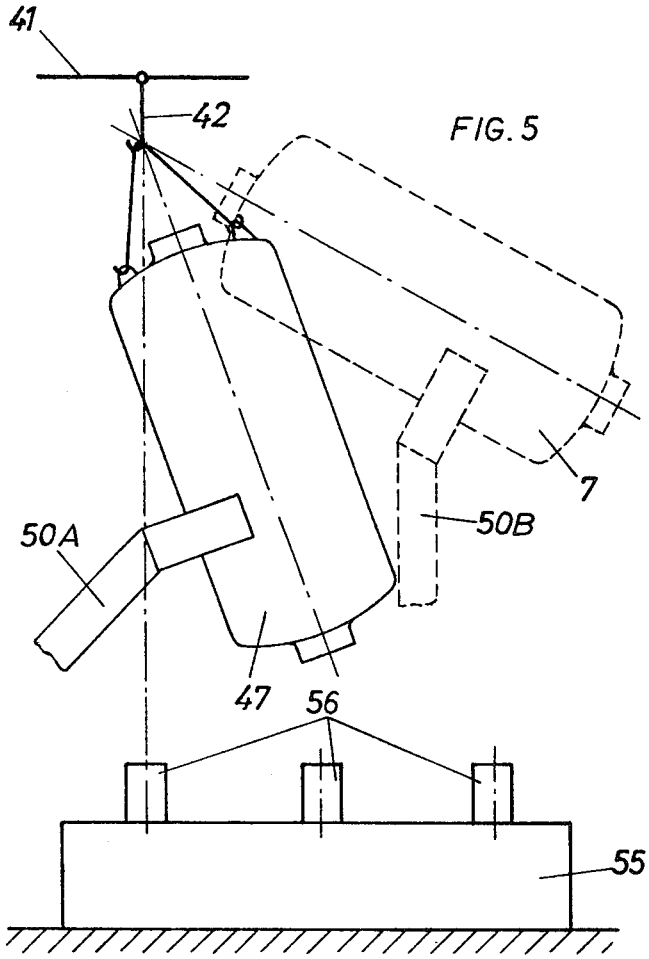
FIG. 5 is a sectional view taken on line V—V in FIG. 4.

The arrangement shown in FIG. 1 and provided with the valve shown in FIGS. 2 and 3 may constitute one of a series of stations which form a processing plant and through which the hollow vessel to be enameled is moved in steps until it is ready to be fired. As is shown in FIG. 4, the system for conveying such hollow vessels comprises a revolving endless chain 41, which is supported by rollers, not shown, and provided with spaced apart holders 42. By these holders 42, the hollow vessels 7 to be enameled on their inside surface are gripped at their top end so that the vessels are vertically suspended as they are moved from one processing station to the other. The hollow vessels 7 may consist, e.g., of hot-water vessels for gas-fired or electrically heated storage-type water heaters, boilers for central heating systems and the like.

The first of these processing stations is the apparatus shown in FIG. 1, which serves to pre-evacuate the hollow vessel and to coat its inside surface with enamel slip. Like parts are designated with the same reference characters. Two gripping jaws 14A are swung in and out transversely to the direction of travel of the chain and when closed hold the boiler in the correct position.

The apparatus described hereinbefore is succeeded by two successive levers 49A, 49B, which move transversely to the direction of travel of the chain 41 and terminate in forks 50A, 50B. These forks are provided with drive rollers 51A, 51B. As will be described more in detail hereinafter, these forks 50A, 50B serve to rotate the hollow vessel 7 in an inclined orientation. The first lever 49A is moved through a larger angle than the second lever 49B so that the hollow vessel is processed first in a more strongly inclined orientation and subsequently in a less strongly inclined orientation.

The next station serves to dry the applied slip and comprises a box 55 for generating hot air, which is blown into the hollow vessels through nozzles 56, which protrude upwardly from the box 55. This station is so arranged that the air discharged by a nozzle or group of nozzles is hotter than the air discharged by the preceding nozzle or group of nozzles.

The plant which has been described has the following mode of operation: When a hollow vessel has arrived over the connecting pipe 5 and has been connected to the suction hose 10, the connecting pipe 5 provided with the diaphragm valve 4 is actuated by the actuators 3 so that the seal 6 of the connecting pipe 5 is forced against the hollow vessel 7. The valve 13 is then opened to establish a connection to the vacuum battery 15 and the vacuum pump so that the hollow vessel 7 is pre-evacuated via the suction pipe 8, the suction hose 10 and the receiver 11 while the valve 4 is closed. The hollow vessel 7 may be pre-evacuated to a vacuum of about 40 to 80 torrs absolute. The pre-evacuation may be controlled by a timer.

When the preselected vacuum has been reached, the diaphragm valve 4 opens and slip 2 flows from the reservoir 1 into the hollow vessel 7 and further into the receiver 11 while the vacuum pump remains in operation. When the slip 2 has reached the switch 12, the latter closes the valve 13. When a preset time has elapsed, the valve 14 opens to the outside air so that surplus slip 2 flows back from the hollow vessel into the reservoir 1.

To close the valve 4, the three-way valve, not shown, connects the conduit 36 to the compressed-air source. As a result, the diaphragm 25 is lifted from the baseplate 21 until the seal ring 29 engages the valve seat 33. The vessel 7 can now be evacuated.

To open the valve 4, the three-way valve is shifted to establish a communication between the outside air or a vacuum source, on the one hand, and the space between the diaphragm 25 and the baseplate 21, on the other hand.

The valve 4 may be actuated by a liquid under a superatmospheric or subatmospheric pressure rather than by compressed air or another compressed gas.

The outer end of the suction hose 10 is placed into a collecting vessel, not shown. Compressed air is then applied to the valve 14 so that the remaining slip 2 flows from the receiver 11 and the suction hose 10 into the collecting vessel. The connecting pipe 5 is subsequently lowered and the diaphragm valve 4 is closed. Now the hollow vessel 7 has been disconnected and can be moved to the next processing station.

The hollow vessel 7 which has been freed from the connecting pipe 5 enters the fork 50A, which imparts to the hollow vessel 7 a strongly inclined orientation and rotates the hollow vessel in said orientation so that the slip is uniformly distributed on the inside surface of the hollow vessel and surplus slip can easily drain into a bowl 57.

A similar operation is performed by the fork 50B, which is swung through a smaller angle so that the bottom of the hollow vessel 7 assumes a less strongly inclined position. In this way the formation of a thicker layer adjacent to the bottom as a result of the inevitable sagging of the slip can be avoided. Surplus slip flows through the bottom opening into the bowl 57.

The slip coating is then dried over the succeeding nozzles 56. Thereafter the hollow vessel is ready to be placed into the kiln for firing the enamel.

What is claimed is:

1. A process of enameling the inside surface of hollow vessels comprising:

connecting to one end of the vessel means for establishing a negative pressure within the vessel;

connecting to the other end of the vessel means for charging the interior of the vessel with slip;

establishing fluid communication between said means for establishing and the interior of the vessel, while blocking fluid communication between said means for charging and the interior of the vessel so that a negative pressure is established within the vessel thereby evacuating substantially all of the air from the vessel whereby air is removed from surface pores and cracks of the vessel;

establishing fluid communication between said means for establishing and the interior of the vessel after air has been removed from the vessel so that slip flows suddenly into the hollow vessel and completely fills the same, the slip being degasified during introduction into the vessel and filling the surface pores and cracks of the vessel; and removing excess slip from the hollow vessel.

2. A process according to claim 1, wherein a negative pressure of about 40 to 80 torrs absolute is established in said vessel prior to establishment of fluid communication between said means for establishing and the interior of the vessel.

3. A process as defined in claim 1 or 2, in which the hollow vessel is evacuated in that air is sucked from the uppermost point of the hollow vessel while the means for charging includes a valve arranged in a conduit for supplying slip to the lowermost point of the hollow vessel, the valve being closed while the air is being sucked out, the conduit being part of a charging and emptying station and being connected to the hollow vessel as it is suspended from a revolving endless chain, from which a plurality of hollow vessels are suspended at equally spaced apart points, and each hollow vessel which has been filled with slip and from which surplus slip has been removed is subsequently moved by said chain through succeeding processing stations in steps having a length which is equal to the spacing of said hollow vessels.

4. A process as defined in claim 3, in which the hollow vessel from which surplus slip has been removed is rotated in a strongly inclined position and thereafter in a less strongly inclined position and surplus slip flows through the bottom opening of the hollow vessel into an underlying vessel when the hollow vessel is rotated in said inclined positions.

5. A process as defined in claim 3, in which the slip which has been applied is treated with hot air at temperatures which are increased in steps.

* * * * *